US006969012B2

(12) United States Patent
Kangas et al.

(10) Patent No.: US 6,969,012 B2
(45) Date of Patent: Nov. 29, 2005

(54) LOW PRESSURE ATOMIZER FOR DIFFICULT TO DISPERSE SOLUTIONS

(76) Inventors: Martti Y. O. Kangas, 3067 McCully Dr., Atlanta, GA (US) 30345; Manfred Diebel, AM Kreuzstein 80, D-63477 Maintal (DE)

( * ) Notice: Subject to any disclaimer, the term of this patent is extended or adjusted under 35 U.S.C. 154(b) by 255 days.

(21) Appl. No.: 10/057,583

(22) Filed: Jan. 24, 2002

(65) Prior Publication Data

US 2003/0136861 A1 Jul. 24, 2003

(51) Int. Cl.[7] ..... A62C 31/00; B05B 7/10

(52) U.S. Cl. ..... 239/400; 239/398; 239/399; 239/402; 239/403; 239/404

(58) Field of Search ..... 239/400, 398, 239/399, 402, 403, 404, 406, 417.5, 418, 239/422, 424.5, 426, 427.3, 430

(56) References Cited

U.S. PATENT DOCUMENTS 3,831,843 A 8/1974 Masai
4,073,436 A 2/1978 Behr
4,221,339 A * 9/1980 Yoshikawa ..... 239/704
4,431,403 A * 2/1984 Nowak et al. ..... 431/183
4,462,543 A 7/1984 Yam
4,595,143 A * 6/1986 Simmons et al. ..... 239/406
4,708,288 A * 11/1987 von Eckardstein ..... 239/9
4,760,956 A 8/1988 Mansfield
4,799,622 A * 1/1989 Ishikawa et al. ..... 239/102.2
4,946,101 A 8/1990 Winheim
5,060,686 A * 10/1991 Troy ..... 137/171
5,092,760 A * 3/1992 Brown et al. ..... 431/10
5,419,491 A * 5/1995 Breitsprecher ..... 239/9
5,810,252 A 9/1998 Pennamen et al.
5,845,846 A 12/1998 Watanabe et al.
5,873,524 A 2/1999 Bodelin et al.
6,010,077 A 1/2000 Casey
6,119,954 A 9/2000 Kamath

* cited by examiner

*Primary Examiner*—Davis Hwu
(74) *Attorney, Agent, or Firm*—Rodgers & Rodgers

(57) ABSTRACT

An atomizer for difficult to disperse solutions such as sizing and paper coatings comprising three nozzles defining three channels respectively two of the nozzles comprising fluid-emitting nozzles and the third nozzle comprising a treatment-emitting nozzle. Alternatively, the atomizer comprises two channels respectively comprising a fluid-emitting nozzle and a treatment emitting nozzle.

21 Claims, 4 Drawing Sheets

LOW PRESSURE ATOMIZER FOR DIFFICULT TO DISPERSE SOLUTIONS

FIELD OF THE INVENTION

This invention relates to atomizing apparatus, in general, and more particularly to specific improvements in atomizing apparatus utilized for precisely controlled dispensation of finely dispersed and difficult to disperse solutions. One such application relates to deposition of paper coatings and sizing material onto moving webs of paper and paperboard. The atomizing apparatus can be also used in dispensing a mixture of highly reactive chemicals when high uniformity in the mixing process is desired.

BACKGROUND OF THE INVENTION

The use of spraying technology for paper coating and sizing applications was tested in the early seventies. This was followed by efforts to apply this technology in a production environment, but the results were largely unsuccessful. The paper industry has been slow to embrace this process, citing potential efficiency impairments created by interruptions in continuous operations. Any such interruption is of great concern in this very capital-intensive industry where production plants must operate non-stop 24 hours a day, seven days a week to remain competitive.

Using spraying techniques to coat or size paper is, in principle, very simple, i.e., a set of nozzles in an applicator box to spray size or coating fluid. This process is shown in minute detail in U.S. Pat. No. 4,944,960 by Donnelly, Kangas and Sundholm, and further developed in their European patent EP 0682571. There have been further efforts to develop spray coating based on high pressure, small-opening nozzles operating at or above 100 bar pressure level, as shown by Koskinen et al. in U.S. Pat. No. 6,060,449.

While spraying with nozzles is certainly not a new process, creating a fine evenly distributed, controllable spray pattern was largely unachievable before the approach outlined by Winheim in U.S. Pat. No. 4,946,101. His patent outlines the historical development of spraying technology in detail, and also introduces the provision for adding a second gas stream via an outer nozzle. This implementation results in an enhanced dispersion capability, but lacked a thermal barrier and the ability to use lubricants and coolants.

When air is used to spray highly viscous and fast-solidifying liquids containing a high concentration of organic and inorganic solids and chemicals, some of these sprayed liquids will crystallize or solidify rather quickly onto the nozzle outlet areas such as the nozzle tip or the outside area from where the dispersing air is released. After the deposit is formed, the spray pattern will be distorted and the process must be stopped to clean the nozzle. This is not acceptable for the paper industry, as mentioned earlier.

Trouble-free spraying has been developed by this invention by preventing the viscous material from solidifying anywhere in the spray nozzle. This improvement to the current technology results from three factors:

1. The nozzle and nozzle tip design as explained in this invention
2. Use of surfacing materials or nozzles made of heat barrier materials including various polymers.
3. Rendering the sticky material or liquid components harmless by preventing contact through lubrication or by dissolving the problematic liquid components (e.g., starch, clay, latexes etc.)

OBJECTS OF THE INVENTION

An object of the invention is to provide a fully controllable spray apparatus for viscous and otherwise difficult to disperse liquids in such a way that the entire cross-section of the spray of atomized liquid contains minute droplets of liquid in uniform distribution.

Another object of the invention is to provide an apparatus which can be used in coating and sizing stations for the paper and board industry to coat and size moving paper and board webs while achieving simultaneously full machine and cross-directional coating or sizing in liquid application control and moisture profiling.

A further object of this invention is to provide an apparatus for low-pressure dispersion using pressurized gas in a nozzle that is especially designed to prevent the typical clogging problems associated with commonly used air-aided low pressure dispersion nozzles. This gas requires a minimum specific moisture content depending on the material to be sprayed. The moisture can be provided by the dispersed lubricant, coolant or water, including steam.

BRIEF SUMMARY OF THE INVENTION

According to this invention, an atomizer utilizes a swirling dispersing action that involves the seamless integration of two or three separate concentric nozzles. The solution to be dispersed is conveyed to the edge of the innermost nozzle where a swirling gas stream will break it into minute droplets in a uniform manner. The external surface of this innermost nozzle has a specific conical design and surface properties. The design objective is to minimize the surface available for solidifying droplets or other material to aid the swirling action and outward speed for the rapidly dispersing solution.

The middle nozzle forms a specially designed concentric pipe around the inner nozzle. Its external surface, together with that of the innermost nozzle, creates an aerodynamically designed entity to help enforce the swirling action and the outward speed by using the Coanda effect. The middle nozzle provides water, air or other chemicals as coolant to insulate the inner nozzle. This includes thermal barrier protection from excessive heat caused by steam and prevents any material from solidifying on the external surface of the inner nozzle.

The outermost nozzle provides the atomizing or dispersion force with pressurized agents such as air, gas, steam or a combination of these elements. The generated dispersion force has two components where the first, starting inside, creates the outward speed momentum and the second component causes the gas to rotate or swirl at high speed while moving towards the outermost edge of the nozzle.

The middle layer can be used for the outward speed momentum, especially when air or other gases are used as coolant.

The material used as well as the design of the inner nozzle is critical. The edge of the nozzle from which the solution exits must be sufficiently thin and sharp thereby minimizing the surface area available for crystallization or deposit accumulation. Wherever feasible, it is preferable to use nonstick coatings such as Teflon on surfaces exposed to the solution.

The apparatus provides for the possibility to implement quantity control of the elements flowing through the middle and inner nozzles, which in turn will open the opportunity to create a complete material and moisture profile control system through a single system. Such a device will be valuable in the manufacture of high quality paper and paperboard products. Sufficient gas pressure must be applied to get full dispersion of the intended liquids. A low pressure of 0.2 to 1.5 bar is sufficient for most coating and sizing liquids; however, the apparatus will withstand high pressure if needed in some other applications.

In an alternative arrangement, according to this invention, the middle nozzle and associated structure are eliminated.

DETAILED DESCRIPTION OF THE INVENTION

Figure 1:
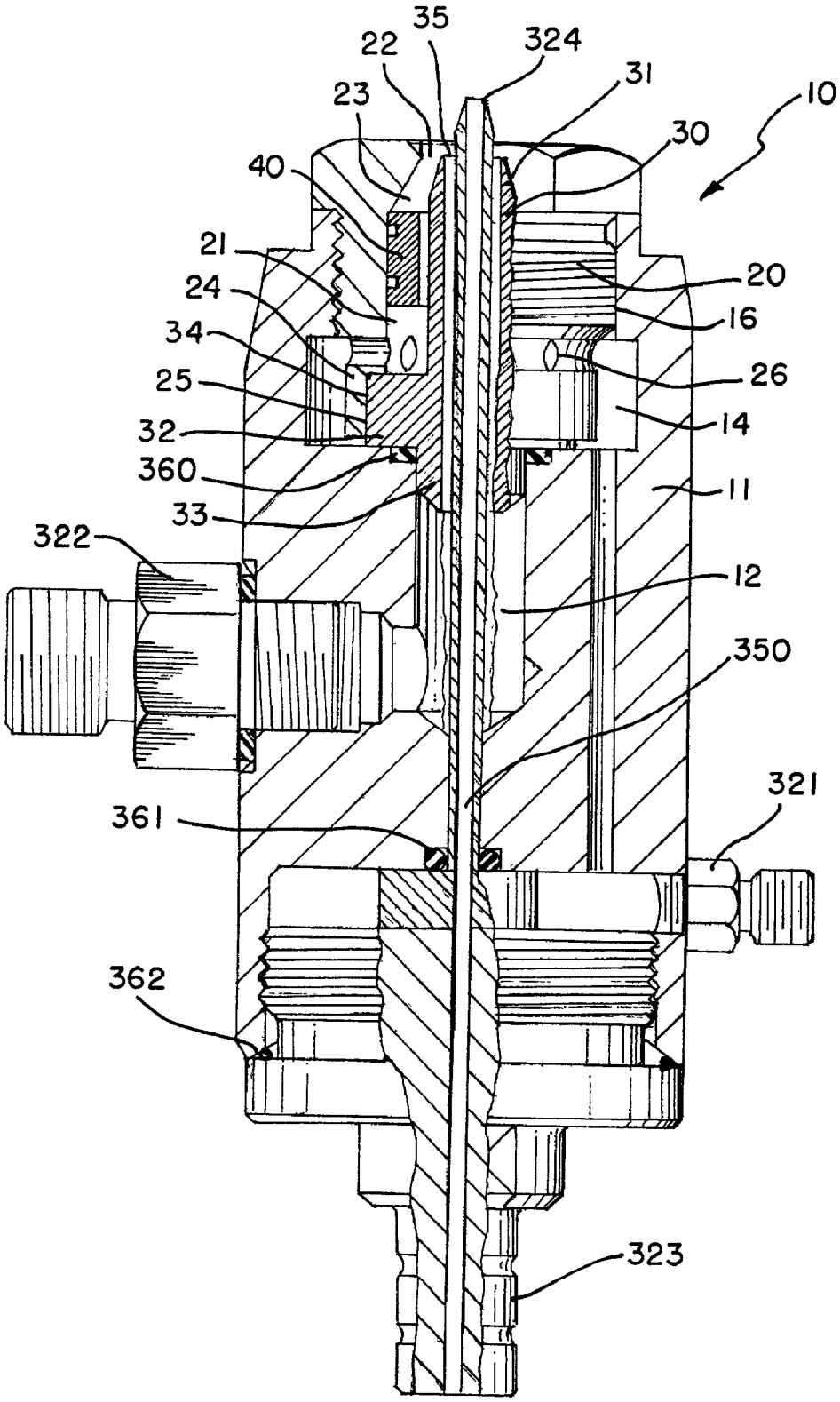
FIG. 1 is a cross-sectional view of one embodiment of the atomizing apparatus.

The atomizing apparatus designated generally by the numeral 10, hereinafter referred to as the atomizer, shown in FIG. 1 comprises a substantially cylindrical housing or body 11, a first nozzle element 20 which receives air at relatively low pressure from an inlet into the housing 11, a second nozzle element 30 which receives a flow of water from a second inlet into the housing 11, and a third nozzle element 350 which receives a flow of liquid from a third inlet into the housing 11. The first nozzle element is integrated to an annular swirling or twisting member 40. The first inlet is defined by a first nipple 321 that extends substantially radial to the housing, the second inlet by a second nipple 322 that also extends substantially radial to the housing and the third inlet by a third nipple 323 that extends axially from one end of the housing 11.

The housing 11 is provided with a substantially axially extending channel 12 which communicates with the second nipple 322 and is defined in part by the slender elongated main section 31 of the nozzle 30. The slightly conical front end portion of this section 31 extends beyond the nozzle element 20, and the channel 35 has a water lubricant, coolant, air or gas discharging portion in the front end portion of the section 31. The water-receiving portion of the channel 35 is provided in an extension 33 which forms part of the nozzle 30 and is received in the channel 12 of the housing 11 via nipple 322. The outer diameter of the extension 33 matches or approximates the outer diameter of the channel 12.

The first nozzle 20 defines, in part alone, in part with the second nozzle 30, in part with the housing 11 and in part with the swirling member 40, a composite channel 14 having a first portion which communicates with the first inlet nipple 321 of the housing 11 and an air discharging second portion 22 which is an angular orifice surrounding the section 31 of the nozzle 30. The maximum diameter portion of the channel 14 communicates with the inlet which is defined by the nipple 321 by way of one or more passages which are provided in the housing 11 in front of and/or behind the plane of FIG. 1. The alternative embodiment for the location of nipple 321 is shown as nipple 321*a* in FIG. 2.

The housing 11 is provided with a substantially axially extending channel 324 which communicates with the third nipple 323 and is defined in part by the slender elongated main section 350 of the nozzle. The slightly conical front end portion of section 350 extends from the housing 11 of the atomizer 10 beyond the nozzle element 20 and the water discharging portion, channel 35, in the front end portion of the section 31.

In order to prevent the material flowing through channel 324 from solidifying, section 350 is made of plastic or other appropriate heat resistant material to form a thermal barrier. This is necessary because the material flowing from nipple 323 is cool whereas the steam or other substance flowing from nipple 322 is hot.

Figure 2:
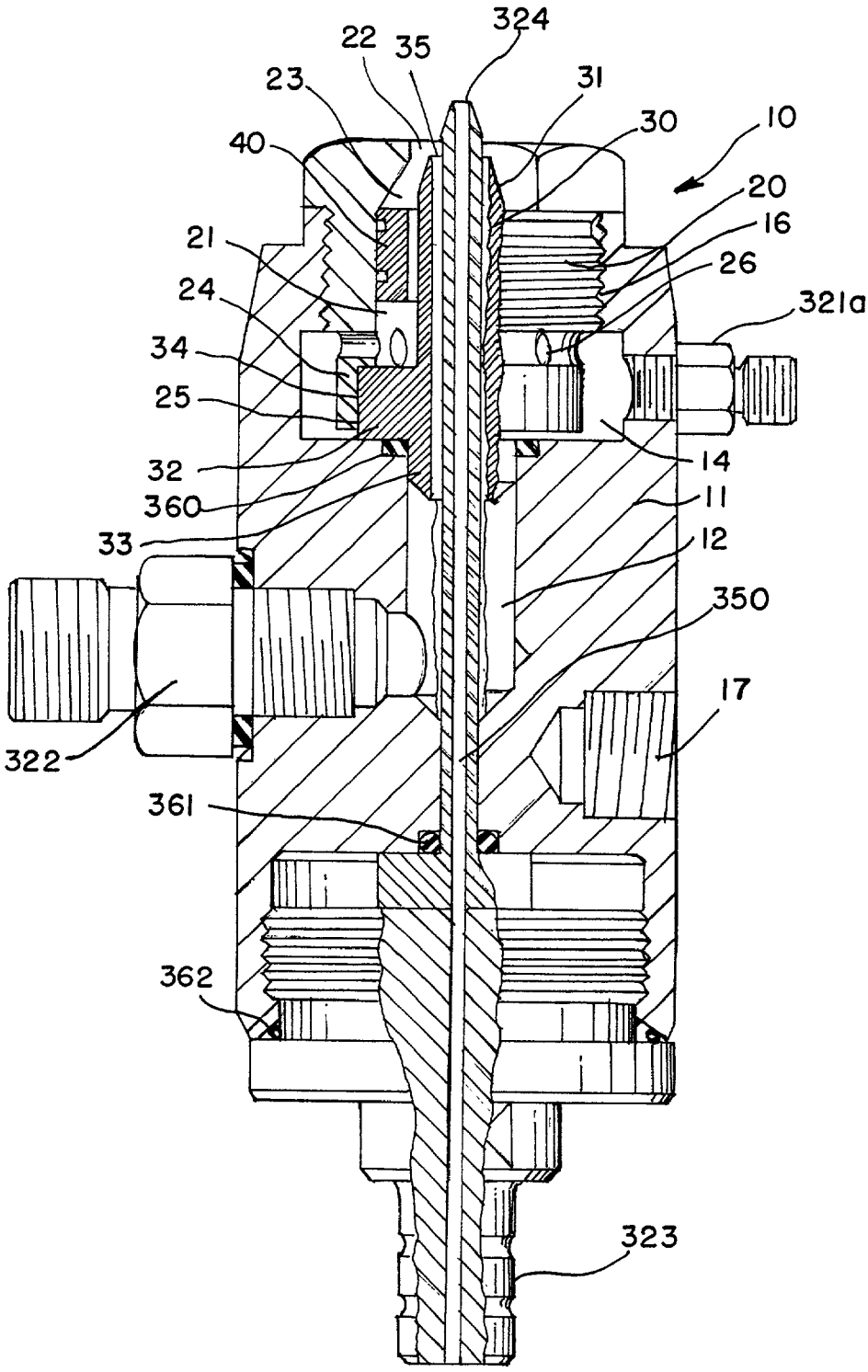
FIG. 2 is a variation of the embodiment shown in FIG. 1 and illustrates an alternative implementation for the nozzle and delivery mechanism carrying gas, air or steam mixture.

The housing 11 in FIG. 2 is further provided with at least one substantially radially extending taped bore 17 for reception of a portion of a threaded fastener (not shown) which secures the atomizer 10 to a support in a machine for wetting webs of paper or other hygroscopic material. The wetting action can involve moving the housing 11 relative to the web and/or vice versa.

The front-end portion of the housing 11 (namely the end portion which is remote from the nipple 323) is provided with an internal thread 16 mating with an external thread 21 of the nozzle 20. The channel 14 includes an elongated portion 23 which is disposed between the nozzles 20, 30 and the cross-sectional area of which decreases in a direction towards the annular air-discharging portion or orifice 22. A larger-diameter section 24 of the nozzle 20 in the maximum-diameter portion of the channel 14 has a precision-finished cylindrical or conical internal surface 25 which closely surrounds and abuts a complementary cylindrical or conical external surface 34 on a section 32 of the nozzle 30. The outer diameter of the section 32 is larger than the outer diameter of the section 31 and/or extension 33, and the section 32 is a tight fit (such as a press fit or a sliding fit) in the section 24 of the nozzle 20. Thus, the internal surface 25 of the section 24 centers the nozzle 30 by way of the external surface 34 of the section 32.

When the improved atomizer 10 is in use, the nipple 322 is connected to a source of water, steam coolant, lubricant, air or gas by a hose or the like, not shown, so that the channel 35 of the nozzle 30 discharges a flow of water. The pressure of water issuing from the tapering end portion of the section 31 is relatively low, e.g., only slightly above atmospheric pressure but the atomizer will operate with efficiency at a pressure up to 100 bar.

The nipple 321 is connected to a source of pressurized air, e.g., to an air compressor, which admits air, gas or steam into the channel 14. The ports 26 convey the admitted gas from the maximum-diameter portion of the channel 14 into the portion 23 which surrounds the section 31 of the nozzle 30. A first part of the air stream which is admitted into the portion 23 is swirled by the member 40 to form a swirling stream having a ring-shaped cross-sectional outline and contacting the outermost layer of the flow of liquid issuing from the end portion of the section 31. The swirling stream of air circulates about the common axis of the nozzles 20, 30 and centering surfaces 25, 34. As the stream flows along and beyond the end portion of the section 31, it breaks up the adjacent layer of the liquid flow into minute droplets so that each layer is converted into a finely atomized flow of liquid particles. The pressure of atomized flow of liquid particles is fairly low which is highly desirable when the flow is used to moisturize a moving web of paper, because the droplets of atomized liquid are readily accepted and retained by the web.

The nipple 323 is connected to a source of liquid, which is the surface treatment solution to be dispersed on to the paper web. The conical edge of the elongated portion 350 extends from the housing 11 of the atomizer 10 beyond the nozzle 20 and its edge is shaped to minimize surface area exposure. In addition, housing 11 is provided with seal rings 360, 361 and 362.

Figure 3:
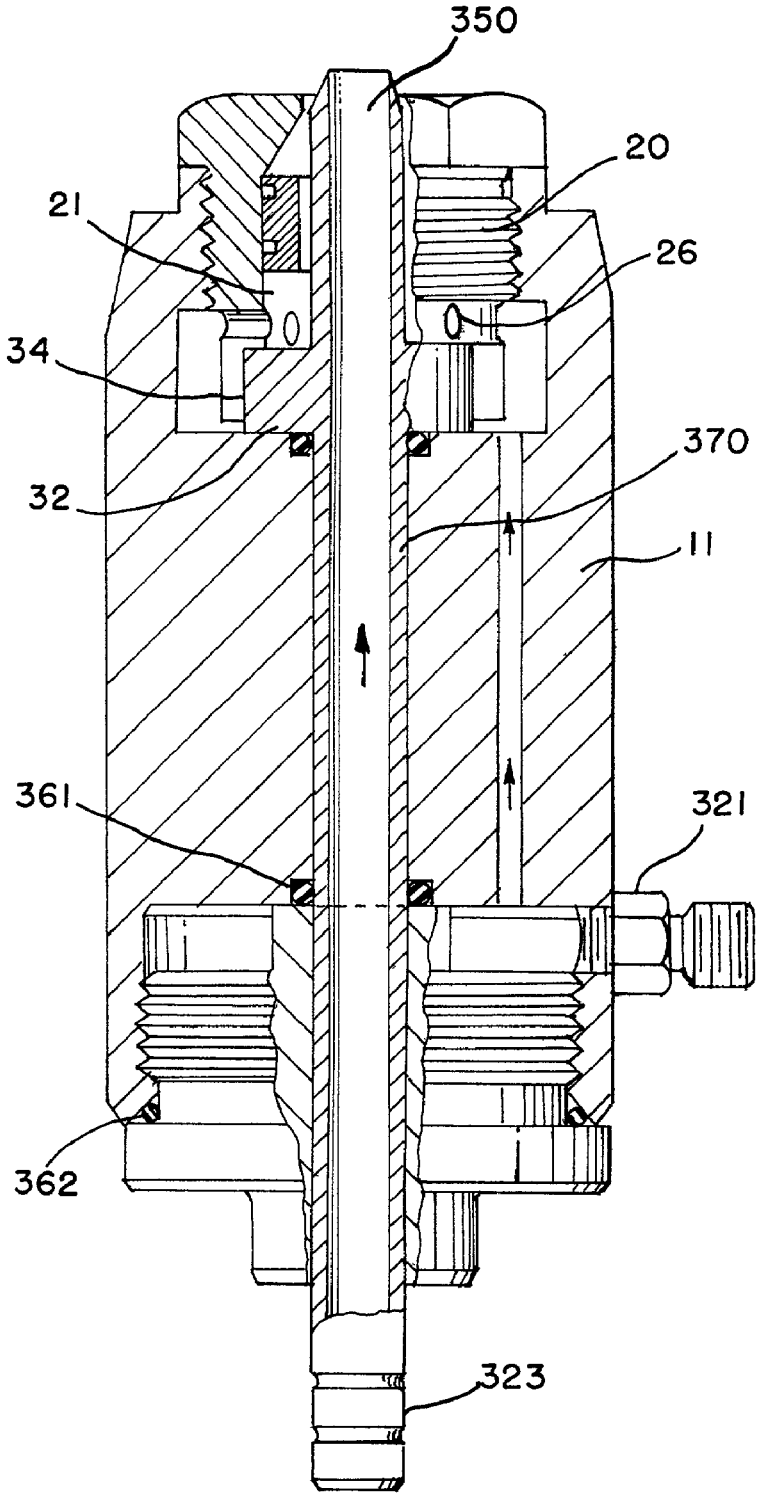
FIG. 3 is a cross-sectional view to illustrate the entry nozzle and delivery mechanism for the gas, air or steam mixture in the two nozzle variation of the invention.

An alternative form of the invention is shown in FIG. 3 whereby air is admitted through nipple 321 and nozzle 20 as explained in connection with the version of the invention shown in FIGS. 1 and 2 and, as explained above, nipple 323 communicates with nozzle portion 350 in the dispersal of surface treatment solution. In order to isolate the surface treatment solution flowing through nozzle portion 350 from the air flowing from nipple 321, thermal barrier 370 formed of heat resistant material such as suitable polymers is disposed between nozzle portion 350 and housing 11.

Figure 4:
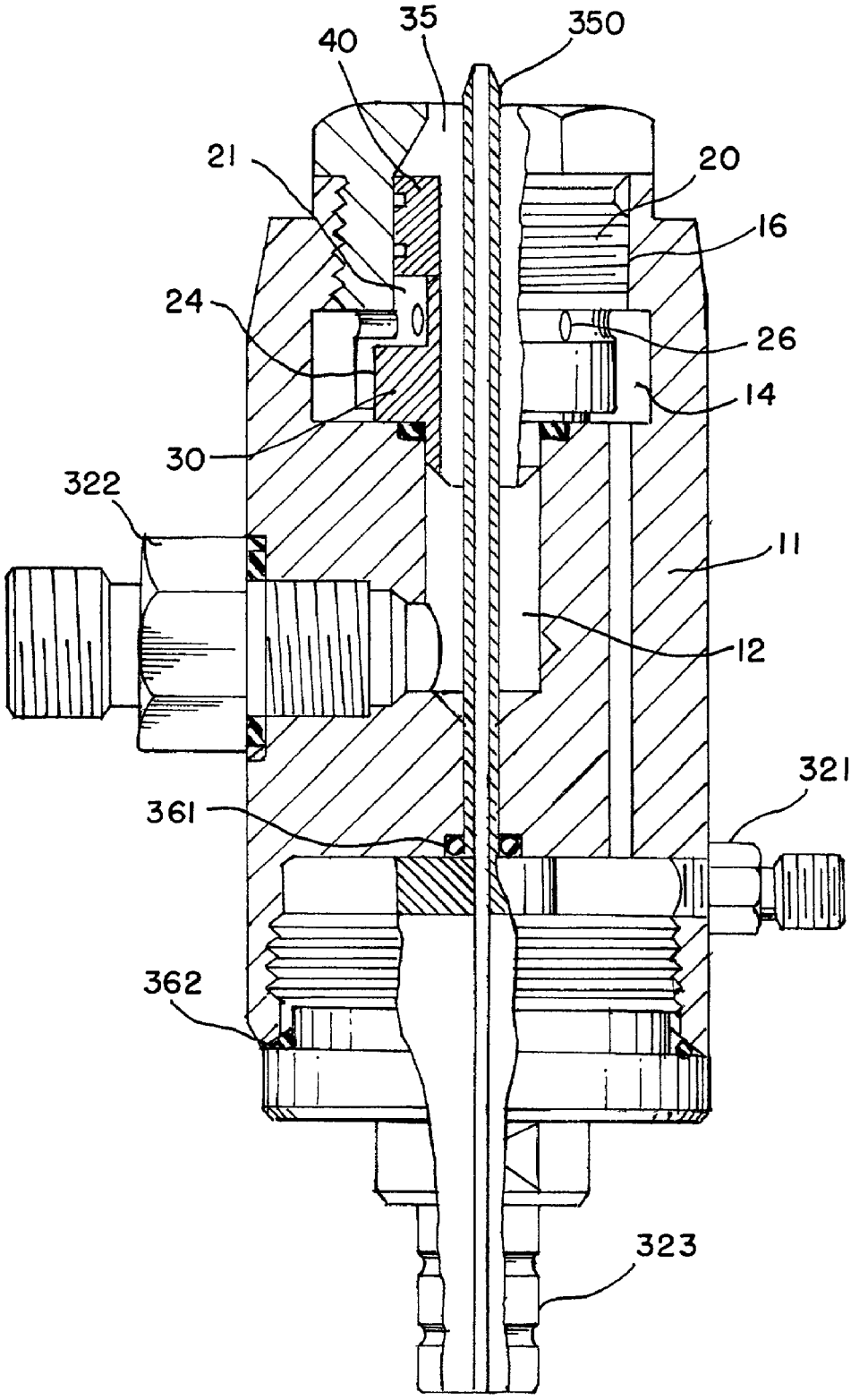
FIG. 4 is a cross-sectional view of a further modification of the atomizer.

Another modification of the invention is shown in FIG. 4 wherein greater flow capacity is achieved in channel 35 of the version shown in FIGS. 1 and 2. More specifically, the upper end of second nozzle element 30 terminated in an abutting relation with the lower edge of angular swirling member 40 such that the inner diameter of nozzle 30 is the same as the inner diameter of angular swirling member 40. By this means and as shown in FIG. 4, the diameter of nozzle 30 is increased and results in a substantially increased flow of water through channel 35.

What is claimed is:

1. An atomizer for paper making comprising a housing, said housing having three inlets, three channels each including a nozzle in communication respectively with said inlets, said three inlets comprising a fluid-receiving first inlet, a fluid-receiving second inlet, a liquid-receiving third inlet, one of said channels being the innermost channel, said innermost channel being associated with said third inlet, the one of said nozzles associated with said innermost channel extending outwardly of said housing beyond the other two of said nozzles, and said innermost channel being uniform in diameter from said liquid-receiving third inlet to the outer end of said nozzle.

2. An atomizer according to claim 1 wherein said first fluid-receiving inlet comprises an air-receiving inlet.

3. An atomizer according to claim 1 wherein said first fluid-receiving inlet comprises a gas-receiving inlet.

4. An atomizer according to claim 1 wherein said first fluid-receiving inlet comprises a steam-receiving inlet.

5. An atomizer according to claim 1 wherein said second fluid-receiving inlet comprises a water-receiving inlet.

6. An atomizer according to claim 1 wherein said second fluid-receiving inlet comprises a coolant-receiving inlet.

7. An atomizer according to claim 1 wherein said second fluid-receiving inlet comprises a lubricant-receiving inlet.

8. An atomizer according to claim 1 wherein said second fluid-receiving inlet comprises a gas-receiving inlet.

9. An atomizer according to claim 1 wherein said fluid-receiving inlet comprises a steam-receiving inlet.

10. An atomizer according to claim 1 wherein said second fluid receiving inlet comprises an air-receiving inlet.

11. An atomizer according to claim 1 wherein an angular swirling member is coaxially disposed in said housing with respect to said second nozzle.

12. An atomizer according to claim 11 wherein the inner diameter of said swirling member is equal to the inner diameter of said second nozzle and wherein the associated end of said second nozzle is disposed in abutting relationship with said swirling member.

13. An atomizer according to claim 1 wherein a nozzle is in communication with at least one of said channels.

14. An atomizer according to claim 1 wherein said fluid issues from said nozzle at a pressure less than 100 bar.

15. An atomizer according to claim 1 wherein said channels are generally concentric and wherein the inner one of said channels is coated in part with nonstick material.

16. An atomizer according to claim 15 wherein the edge of said inner channel nozzle is sharp.

17. An atomizer according to claim 1 wherein one of said channels is an inner channel and another of said channels is a middle channel and wherein said inner and middle channels are separated by heat resistant material.

18. An atomizer comprising a housing, said housing having three inlets, three channels each including a nozzle in communication respectively with said inlets, said three inlets comprising a fluid-receiving first inlet, a fluid-receiving second inlet, and a liquid-receiving third inlet, an angular swirling member coaxially disposed in said housing with respect to said second nozzle, the inner diameter of said swirling member being equal to the inner diameter of said second nozzle, and the associated end of said second nozzle being disposed in abutting relationship with said swirling member.

19. An atomizer comprising a housing, said housing having three inlets, three channels each including a nozzle in communication respectively with said inlets, said three inlets comprising a fluid-receiving first inlet, a fluid-receiving second inlet, a liquid-receiving third inlet, one of said channels being an inner channel, said inner channel associated with said third inlet and being uniform in diameter, the one of said nozzles associated with said inner channel extending outwardly of said housing beyond the other two of said nozzles, an angular swirling member coaxially disposed in said housing with respect to said second nozzle, the inner diameter of said swirling member being equal to the inner diameter of said second nozzle, and the associated end of said second nozzle being disposed in abutting relationship with said swirling member.

20. An atomizer comprising a housing, said housing having three inlets, three channels each including a nozzle in communication respectively with said inlets, said three inlets comprising a fluid-receiving first inlet, a fluid-receiving second inlet, a liquid-receiving third inlet, one of said channels being the innermost channel, said innermost channel being associated with said third inlet and being uniform in diameter, the one of said nozzles associated with said innermost channel extending outwardly of said housing beyond the other two of said nozzles, and an angular swirling member coaxially disposed in said housing with respect to said second nozzle.

21. An atomizer according to claim 20 wherein the inner diameter of said swirling member is equal to the inner diameter of said second nozzle and wherein the associated end of said second nozzle is disposed in abutting relationship with said swirling member.

* * * * *